US006659911B2

(12) United States Patent
Suzuki et al.

(10) Patent No.: US 6,659,911 B2
(45) Date of Patent: Dec. 9, 2003

(54) SHIFT ASSIST SYSTEM FOR AN OUTBOARD MOTOR

(75) Inventors: Masaru Suzuki, Shizuoka (JP); Sadato Yoshida, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/997,124

(22) Filed: Nov. 28, 2001

(65) Prior Publication Data

US 2002/0065169 A1 May 30, 2002

Related U.S. Application Data

(60) Provisional application No. 60/322,192, filed on Sep. 13, 2001.

(30) Foreign Application Priority Data

Nov. 28, 2000 (JP) ..... 2000-361067

(51) Int. Cl.[7] ..... B63H 20/20

(52) U.S. Cl. ..... 477/109; 477/906; 440/1; 440/84

(58) Field of Search ..... 477/107, 109, 477/906; 440/1, 75, 86, 84

(56) References Cited

U.S. PATENT DOCUMENTS

| | | | | |
|---|---|---|---|---|
| 4,527,441 A | | 7/1985 | Nakahama | |
| 4,549,869 A | | 10/1985 | Iida et al. | |
| 4,637,802 A | | 1/1987 | Taguchi et al. | |
| 4,924,724 A | | 5/1990 | Yoshimura | |
| 4,963,109 A | | 10/1990 | Hayasaka | |
| 4,973,274 A | | 11/1990 | Hirukawa | |
| 5,051,102 A | | 9/1991 | Onoue | |
| 5,072,629 A | * | 12/1991 | Hirukawa et al. | 477/101 |
| 5,230,643 A | | 7/1993 | Kanno | |
| 5,350,325 A | | 9/1994 | Nanami | |
| 5,403,246 A | * | 4/1995 | Umemoto | 477/109 |
| 5,474,007 A | | 12/1995 | Kobayashi | |
| 5,692,992 A | * | 12/1997 | Arvidsson et al. | 477/101 |
| 5,700,168 A | * | 12/1997 | Mondek et al. | 440/1 |
| 5,827,150 A | | 10/1998 | Mukumoto | |
| 5,853,306 A | * | 12/1998 | Worth et al. | 440/1 |
| 6,015,319 A | | 1/2000 | Tanaka | |
| 6,098,591 A | | 8/2000 | Iwata | |
| 6,217,480 B1 | | 4/2001 | Iwata et al. | |
| 6,406,342 B1 | * | 6/2002 | Walczak et al. | 440/84 |

FOREIGN PATENT DOCUMENTS

| | | |
|---|---|---|
| JP | 02-216391 | 8/1990 |
| JP | 2759475 | 3/1998 |

* cited by examiner

*Primary Examiner*—Ankur Parekh
(74) *Attorney, Agent, or Firm*—Knobbe, Martens, Olson & Bear, LLP

(57) ABSTRACT

A shift assist system for an outboard motor regulates the torque of the engine to ensure proper effortless shifting. The system recognizes open circuit or short circuit faults and nevertheless enables the torque of the engine to be reduced to facilitate easy gear selection.

19 Claims, 3 Drawing Sheets

SHIFT ASSIST SYSTEM FOR AN OUTBOARD MOTOR

PRIORITY INFORMATION

This application is based on and claims priority to Japanese Patent Application No. 2000-361067, filed Nov. 28, 2000 and to the Provisional Application No. 60/322192, filed Sep. 13, 2001, the entire contents of which is hereby expressly incorporated by reference.

FIELD OF THE INVENTION

The present invention relates generally to a shift assist control arrangement for an engine, and more particularly to an improved shift assist control arrangement for a split-bank, multicylinder engine.

DESCRIPTION OF THE RELATED ART

In many forms of marine propulsion systems, the powering internal combustion engine drives a propulsion device through a transmission. Conventionally, the transmissions utilized for this purpose are bevel gear forward, neutral, reverse transmissions shifted by means of dog clutches. These transmissions have the advantage of being able to transmit large amounts of power while maintaining a relatively small and compact assembly. However, this type of transmission has problems in that the engagement of the dog clutches can be difficult at times. This is particularly true if the engine is running at a high speed or developing a large amount of power at the time the shift is attempted.

It has, therefore, been the practice to provide a variety of shift assisting mechanisms which will automatically reduce the speed of the engine when high shifting forces are encountered. For example, Japanese Patent No. 2759475 and U.S. Pat. No. 6,098,591 disclose shift assist arrangements.

SUMMARY OF THE INVENTION

This invention relates to an improved engine control system and method and more particularly to an improved control system and method for engines and particularly to drive transmissions incorporating shift assists. The preferred embodiments of the invention provide an improved shift assist system for a watercraft and particularly for watercraft with an outboard motor.

In accordance with one aspect of a preferred embodiment of the shift assist control system of this invention, the shift force detecting unit includes a shift force detection switch and a neutral switch connected to a shift mechanism. The shift mechanism is connected to a dog clutch in the transmission unit. The force detecting unit relays information to the electronic control unit, and engine torque is then lowered depending on the value of the current traveling through the force detecting unit. A significant feature of the preferred embodiments of this invention is that the shift assist system is not adversely affected by abnormal control circuit faults including a short circuit or an open circuit failure of the shift control system.

In accordance with another aspect of a preferred embodiment of the invention, operation of the operator controlled shifting is detected to effect a change in transmission ratio and reduce the torque of the engine in response to a sensed operation of the operator controlled shifting.

A further aspect of a preferred embodiment of the invention is a shift assist control system including an electronic control unit that responds to both normal shifting of the engine and abnormal conditions produced by either an electrical disconnect with the shift force-detecting switch or a short circuit in the force-detecting switch.

Another aspect of a preferred embodiment of the invention is a shift assist system which normally supplies a current of known value to the engine's electronic control unit. However, during a shift that requires an excessive force or an abnormal condition of circuit disconnect or short-circuit, this current value is changed and this change in current value is detected by the electronic control unit to automatically reduce the speed of the engine.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise three figures in which.

DETAILED DESCRIPTION OF THE PREFERRED EMBODIMENT

THE OVERALL CONSTRUCTION

Figure 1:
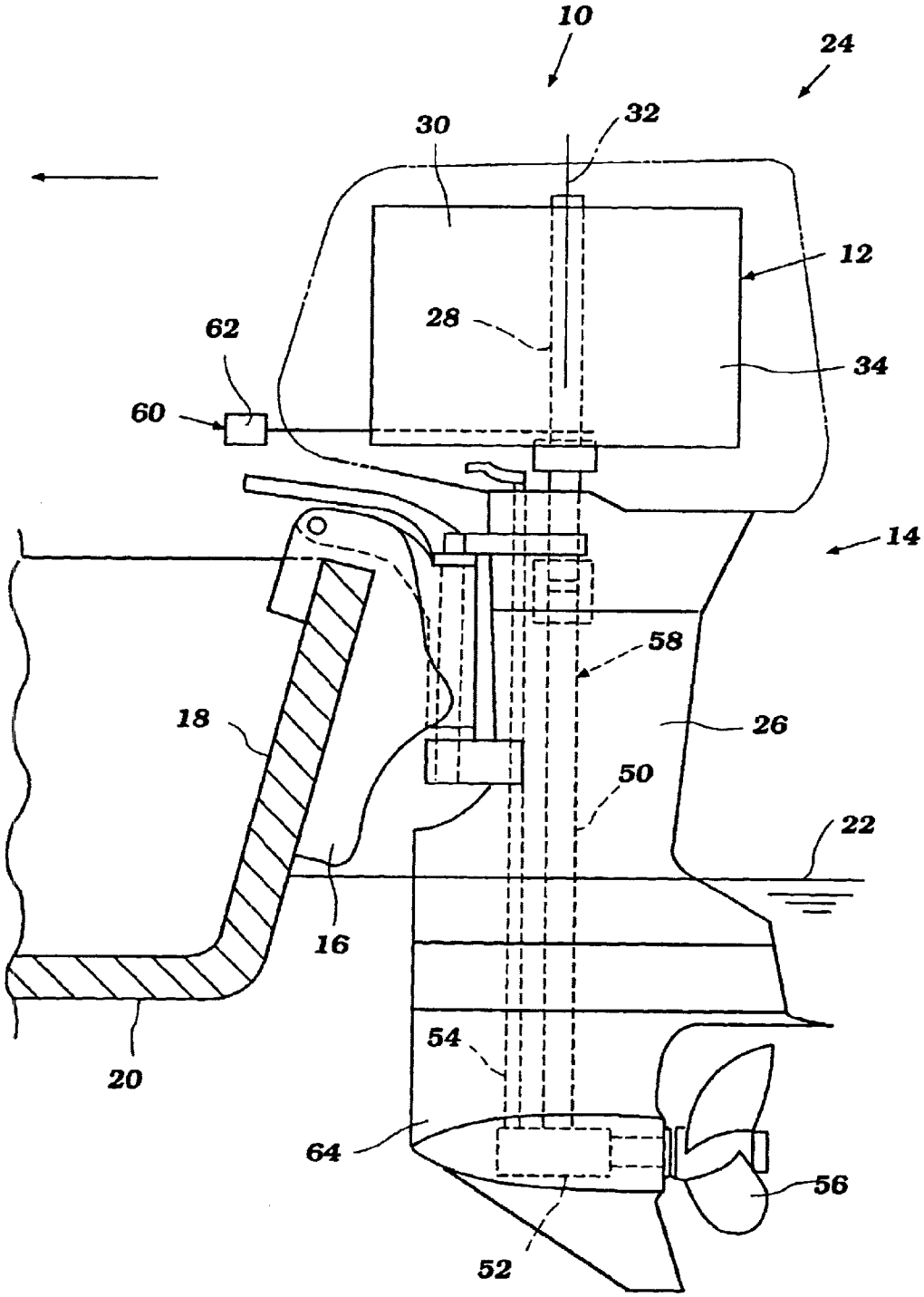
FIG. 1 is a side elevational view of an outboard motor configured in accordance with a preferred embodiment of the present invention, with an associated watercraft partially shown in section.

FIG. 1 illustrates an overall construction of an outboard motor 10 that employs an internal combustion engine 12 configured in accordance with certain features, aspects and advantages of the present invention. The engine 12 has particular utility in the context of a marine drive, such as, for example the outboard motor 30, and thus is described in the context of an outboard motor. The engine 12, however, can be used with other types of marine drives (i.e., inboard motors, inboard/outboard motors, etc.) and also with certain land vehicles, which include lawnmowers, motorcycles, go carts, all terrain vehicles, and the like. Furthermore, the engine 12 can be used as a stationary engine for some applications that will become apparent to those of ordinary skill in the art.

In the illustrated arrangement, the outboard motor 10 generally comprises a drive unit 14 and a bracket assembly 16. The bracket assembly 16 supports the drive unit 14 on a transom 18 of an associated watercraft 20 and places a marine propulsion device (e.g., a propeller) in a submerged position with the watercraft 20 resting relative to a surface 22 of a body of water.

The illustrated drive unit 14 comprises a power head 24, a driveshaft housing 26, and a lower unit 28. The power head 24 is disposed atop the driveshaft housing 26 and includes an internal combustion engine 12.

The engine 12 in the illustrated embodiment operates on a four-cycle combustion principle. This type of engine, however, merely exemplifies one type of engine on which various aspects and features of the present invention can be suitably used. A typical engine has two cylinder banks, which extend separately of each other. However, engines having other numbers of cylinders, other cylinder arrangements (in-line, opposing, etc.), and operating on other combustion principles (e.g., crankcase compression two-stroke or rotary) also can advantageously employ various features, aspects and advantages of the present invention. In addition, the engine can be formed with separate cylinder bodies rather than a number of cylinder bores formed in a cylinder block. Regardless of the particular construction, the preferred engine embodiment comprises an engine body that includes at least one cylinder bore.

A crankshaft 28 extends generally vertically through a cylinder block 30 and can be journaled for rotation about a rotational axis 32 by several bearing blocks. Connecting rods (not shown) couple the crankshaft 28 with the respective pistons (not shown) in any suitable manner. Thus, the reciprocal movement of the pistons (not shown) rotates the crankshaft 28.

As shown in FIG. 1, the cylinder block 30 is preferably located at the forwardmost position of the engine 12. A cylinder head assembly 34 is disposed rearward from the cylinder block 30. Generally, the cylinder block 30 (or individual cylinder bodies) and the cylinder head assembly 34 together define the engine 12.

Figure 2:
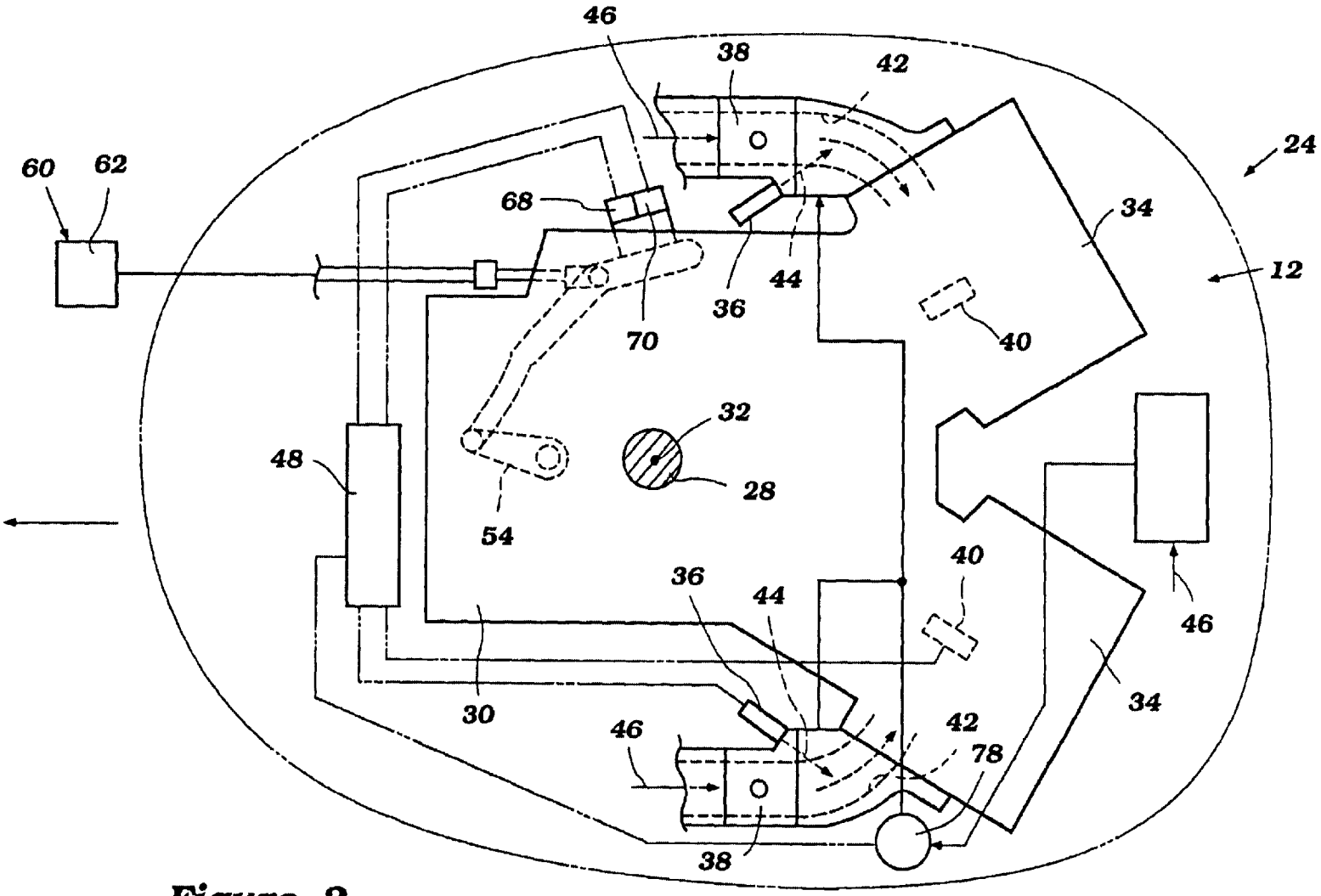
FIG. 2 is a top view of an outboard motor configured in accordance with a preferred embodiment of the present invention, with various parts shown in phantom.

With reference now to FIG. 2, the engine 12 preferably has an indirect, port or intake passage fuel injection system. The fuel injection system preferably comprises at least two fuel injectors 36 with one fuel injector allotted for each one of the respective cylinders. The fuel injectors 36 preferably are mounted on throttle bodies 38.

The engine 12 further has an ignition system comprising spark plugs 40 and a triggering system (not shown).

Each fuel injector 36 preferably has an injection nozzle directed downstream within associated intake passages 42, which are downstream of the throttle bodies 38. The fuel injectors 36 spray fuel 44 into the intake passages 42 where the fuel is met and atomized with incoming induction air 46.

Figure 3:
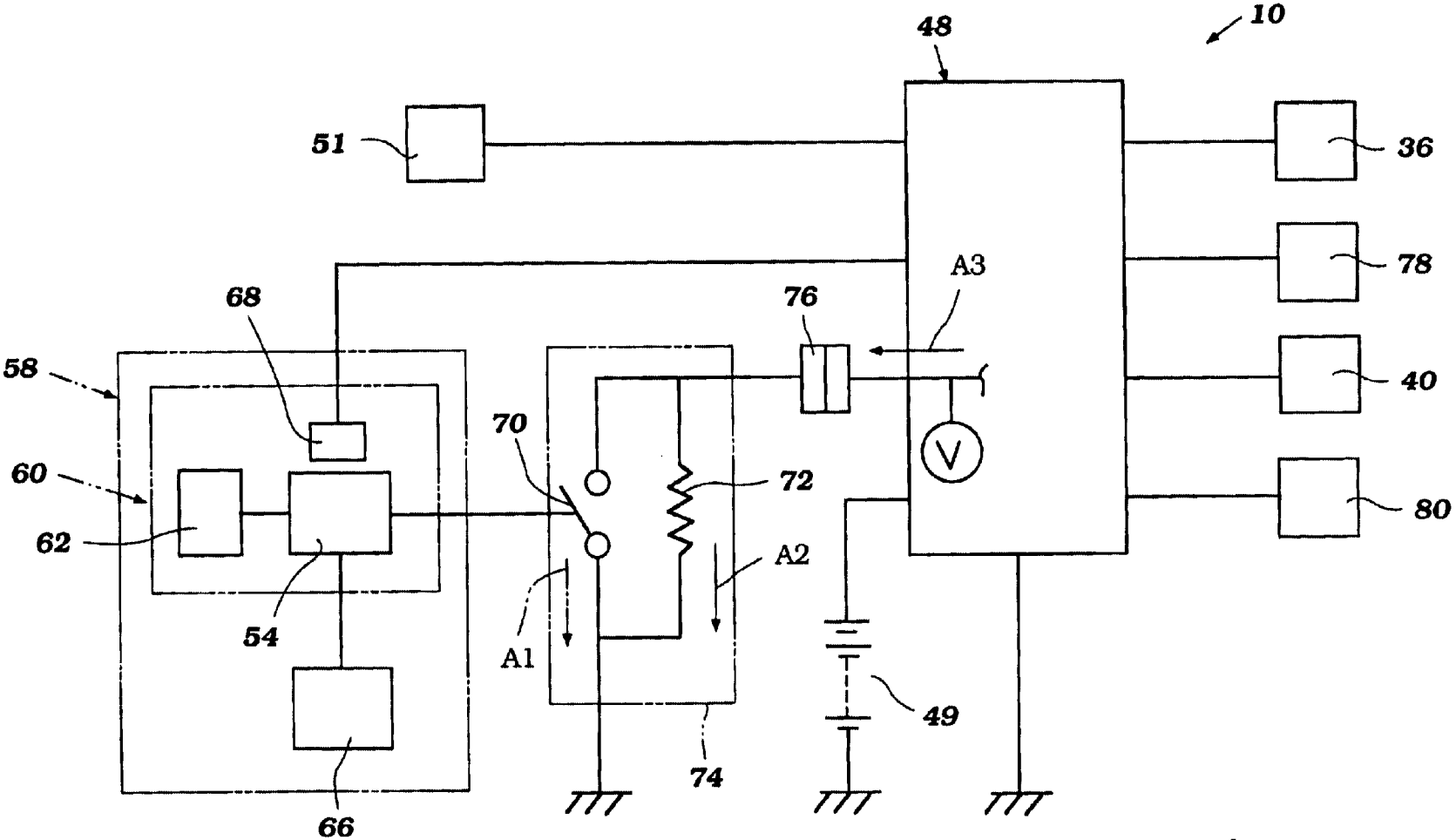
FIG. 3 is a schematic drawing illustrating the shift assist control system.

As shown in FIG. 3, an electronic control unit (ECU) 48 receives power from a battery 49 and is coupled to an engine speed sensor 51 responsive to the rotational velocity of crankshaft 28. The ECU 48 controls both the initiation timing and the duration of the fuel injection cycle of the fuel injectors 36 so that the nozzles spray a proper amount of fuel each combustion cycle. The ECU 48 also controls the ignition timing of the sparks plugs 40 in order to correctly facilitate the ignition of the air-fuel mixture.

The engine 12 also typically includes a cooling system, a lubrication system and other systems, mechanisms or devices other than the systems described above.

As shown in FIG. 1, the driveshaft housing 26 depends from the power head 24 to support a driveshaft 50 which is coupled with the crankshaft 28 and extends generally vertically through the driveshaft housing 26. The driveshaft 50 is journaled for rotation and is driven by the crankshaft 28.

The drive unit 14 depends from the driveshaft housing 26 and supports a transmission unit 52 that is driven by the driveshaft 50. The transmission unit 52 extends generally horizontally through a lower unit 64 and is operated by a shift mechanism 54. A propulsion device is attached to the transmission unit 52. In the illustrated arrangement, the propulsion device is a propeller 56 that is in communication with the transmission unit 52. The propulsion device, however, can take the form of a dual counter-rotating system, a hydrodynamic jet, or any of a number of other suitable propulsion devices.

The Shift Assist Control System

With reference now to FIG. 3, a schematic drawing illustrating the shift assist control system is shown. Within a power transmission unit 58 are various shifting components in order to shift the transmission unit 52. A shift actuating unit 60 includes an operating coupling 62 which translates the operators shift request to the shifting mechanism 54. The shifting mechanism 54 moves a dog clutch 66 in a direction dependent on whether forward or reverse gear is selected. A neutral detection switch 68 senses when the shift mechanism 54 is in neutral e.g. when neither forward or reverse gear is chosen and the engine 12 is allowed to run while letting the propeller 56 stand idle.

Attached to the shift mechanism 54 is a shifting force-detecting switch 70 combined within an abnormality detecting parallel resistor circuit 72 making up a shifting force detection unit 74. The shifting force detection unit 74 determines the amount of force required to move the dog clutch 66 when engaging or disengaging the dog clutch 66 from forward or reverse gear. An easily accessible connector 76 communicates a signal between the shifting force detection unit 74 and the ECU 48.

An electrical current A3 traveling through an easily accessible connector 76 is made up of two currents, A1, A2 and allows the ECU to correctly determine if engine speed should be reduced in order to protect the dog clutch 66 and assist in easier shifting. The current A1 is designated as the current that travels through the shifting force-detecting switch 70 and the current A2 is designated as the current that travels through the parallel resistor circuit 72.

During normal driving operation, the dog clutch 66 is engaged in either forward or reverse gear. When forward or reverse is engaged the neutral detection switch 68 and the shifting force detection switch 70 are open, the current A1 equals zero, and the ECU 48 detects a current A3 equal to the current flow A2 traveling through the parallel resistor circuit 72. In another arrangement a high shifting force gear engaging state may be realized and the engine speed is reduced by various means including ignition and/or fuel injection timing or cutoff or through the operation of the air bypass valve 78. By reducing the engine speed, an assisted engaging shift operation can be easily performed.

It is conceivable due to the normal vibrations and operation of a watercraft that a short circuit or an open circuit fault may present itself. The present invention is designed to detect such errors and still provide adequate shifting assistance.

If the ECU measured current A3 equals zero it is determined that an open circuit is present within or between the shifting force detection unit 74 and the ECU 48. An alarm 80 is activated and the ECU 48 lowers the engine speed in order to provide a smooth shifting environment. Alarm 80 may be either or both an audible alarm and a visual alarm such as a flashing electrical lamp.

If the ECU measured current A3 is equal to the current A1 traveling through the shifting force-detecting switch 70 for a predetermined amount of time greater than the normal shifting time of "X", it is determined that a short circuit is present within or between the shifting force detection unit 74 and the ECU 48. The alarm 80 is activated and the ECU 48 lowers the engine speed in order to provide a smooth shifting environment. If a disturbance in shifting capability is noticed by the operator the connector 76 can always be disconnected in order to produce an open circuit between the shifting force detection unit 74 and the ECU 48. Although disconnecting the connector 76 will reduce engine performance, it allows a "limp home" mode and lets the transmission 52 be easily shifted in order to continue to operate the watercraft 20 safely.

Operation of the Shift Control System

In operation, during a high shifting force gear disengaging state, the shifting force-detecting switch 70 is closed, and the ECU measured current A3 equals the current A1 traveling through the shifting force-detecting switch 70. When the ECU 48 recognizes the current A3 equals the current A1 for a predetermined amount of time less than "X", a high shifting force gear disengaging state is realized. The engine speed is then reduced by various means including ignition and/or fuel injection timing or cutoff or through the operation of an air bypass valve 78. By reducing the engine speed, an assisted disengaging shift operation can be easily performed. The shift control system shown in FIGS. 2 and 3 operates under "normal" and "abnormal" conditions described below to provide significant improvement in the state-of-the-art of shift assist control systems.

Normal Conditions

Normal Operation Before and After Shifting

Force detecting switch 70 is normally open circuit, i.e., under normal operating conditions it is only closed during shifting that requires excessive operator force. Accordingly, the only current flowing in circuit 72 is current A2 through resistor 72. So long as the voltage of battery 49 does not drop below its normal voltage, current A2 will remain substantially constant at a value N. The current detector circuitry within the ECU responds to currents above or below this normal value of N current flow. Thus, the ECU will not operate to automatically reduce engine speed or sound the alarm 80 when the current has the normal value of N.

Normal Operation During Shifting

Normal operation includes excessive operator force that is necessarily applied during a shift sequence by virtue of the dog clutch mechanism. When the operator is required to exert a force on the shift lever greater than a predetermined value, the resistor 72 is shorted by the closure of switch 70. As a result, the current flow A3 to ECU 48 is equal to a current flow A1 which is greater than N. Since the current A3 to ECU 48 is now greater than the steady-state current N (A2) when switch 70 is open, the current detector within ECU 48 detects this change and automatically reduces the engine RPM to assist this shifting operation by reducing the frictional force generated by the engagement of the dog clutch. Advantageously, the reduction in RPM occurs within approximately 0.5 seconds. As soon as the operator reduces the force applied to the shifter mechanism, switch 70 is opened. The current to the ECU is once again equal to the N current value A2. This reduction in current N is detected by ECU 8 which automatically returns the engine RPM to its normal rotational velocity.

A shift requiring excessive force requires this relatively short period of time X. Accordingly, the automatic timer within the ECU does not sound the alarm during a normal "excessive force" shift of the engine.

Abnormal Conditions

Switch 70 Fails Closed Circuit

If force detecting unit 74 fails in a closed circuit mode, the ECU detects the increased current flow A1. When this current flows longer than X, the period of time preset by the automatic timer within the ECU circuit, the ECU actuates alarm 80 notifying the operator of the abnormal condition. If the operator is unable to shut off the alarm, the operator can disconnect the connector 76 resulting in zero current flow. This condition is described below. In any event, a short circuit of unit 74 results in a reduced engine RPM so that the operation can easily shift the dog clutch mechanism and run the engine in a reduced power mode.

Open Circuit Failure

When a line disconnection occurs between the shift force detection unit 74 and the ECU 48, zero current 43 will flow to the ECU 48. This change in current value is detected by the ECU current detection circuitry and the engine RPM is automatically reduced. This non-intentional fluctuation of the engine 12 will be felt by the operator who can either fix the connection or operate in a "limp home" condition with an engine operating, but at a reduced RPM. Shifting of the dog clutch does not present any problem because of the reduced power of the engine. Further, the ECU circuit advantageously differentiates between a line-disconnection and a short-circuit within unit 74 by changing the flashing interval of the visual lamp of alarm 80.

Battery Voltage Drops Below a Predetermined Value

The voltage of battery will fall below a predetermined value if the battery is failing or the electrical changing system is not operating to change the battery. In one embodiment of the invention, the ECU detects both a zero current flow caused by an electrical disconnect and a current flow greater than zero but less than N. This lower current value is produced by battery 49 being in a low voltage state. As a result, the voltage across the resistor may be reduced. As in the line-disconnect mode described above, this reduced current can be detected within the ECU and the operator is immediately notified of this problem. Advantageously, alarm 80 includes a flashing light which is energized to advise the operator of a low voltage condition.

The monitored current parameters A1, A2, and A3 thereby enable the ECU 48 to accurately assess when shifting assistance is required and when a fault is present within the shift assist control system, which increases transmission shifting response, overall performance, improves reliability, and provides accurate driving response and efficiency.

Thus, from the foregoing description it should be readily apparent that the described construction is very effective in providing an improved shift assist system insuring good shifting operation regardless of open circuit or shorted shift control electrical connections. Of course, the foregoing description is that of a preferred embodiment of the invention and various changes and modifications may be made without departing from the spirit and scope of the invention, as defined by the appended claims.

What is claimed is:

1. A system for assisting shifting of a fuel injected marine engine that recognizes an open circuit or short circuit faults and automatically reduces the engine speed comprising:

a shift force detection unit including a switch responsive to an excessive force applied to a shift lever that is involved with shifting the marine engine, an electronic control unit coupled to the engine to control the timing and duration of the fuel injection cycle of said engine and the ignition timing of said engine, a current detector within said electronic control unit for detecting an amount of current from said shift force detection unit and automatically reducing the engine RPM when said amount of current is greater than or less than a value of N, said shift force detection unit including a current generator comprising a resistor in parallel with said switch, an amount of current of value N being produced when the battery voltage is across the resistor and the switch is open, an amount of current greater than N being produced when the switch closed, an amount of current greater than N being produced when the switch is abnormally short circuited, and an amount of current less than N being produced when the shift detection unit has an open circuit or is disconnected from the electronic control unit.

2. A system for assisting shifting of a fuel injected engine, the system comprising:

a shift force detection unit including a switch responsive to an excessive force applied to a shift lever that is involved with shifting the engine, an electronic control unit coupled to the engine to control at least one of the timing and duration of the fuel injection cycle of said engine and the ignition timing of said engine, a current detector within said electronic control unit for detecting an amount of current from said shift force detection unit and automatically reducing the engine RPM when the said current is greater than or less than a value of N, said shift force detection unit including a current generator comprising a resistor in parallel with said switch, an amount of current of value N being produced when the battery voltage is across the resistor and the switch is open, an amount of current greater than N being produced when the switch closed, and an amount of current greater than N being produced when the switch is abnormally short circuited.

3. A system for assisting shifting of an engine, the system comprising:

a shift force detection unit including a switch responsive to an excessive force applied to a shift lever that is involved with shifting the engine, an electronic control unit coupled to the engine to control the engine output power, a current detector within said electronic control unit for detecting an amount of current from said shift force detection unit and automatically reducing the engine output power when said amount of current is greater than or less than a value of N, said shift force detection unit including a current generator comprising a resistor in parallel with said switch, an amount of current of value N being produced when the battery voltage is across the resistor and the switch is open, an amount of current greater than N being produced when the switch closed, an amount of current greater than N being produced when the switch is abnormally short circuited, and an amount of current less than N being produced when the shift detection unit has an open circuit or is disconnected from the electronic control unit.

4. The system of claim 3 including an alarm coupled to said electronic control unit, said electronic control unit including a timer for activating said alarm when an amount of current greater than N flows for a predetermined period of time.

5. The system of claim 4 when said predetermined period is greater than a normal shift occurrence during which said switch is closed.

6. A system for assisting shifting through a shift lever of an engine, the system comprising:

a shift force detection unit including a switch responsive to an excessive force applied to the shift lever, an electronic control unit coupled to the engine to control the engine output power, a current detector within said electronic control unit for detecting an amount of current from said shift force detection unit, said electronic control unit automatically reducing the engine output power when said amount of current is greater than or less than a value of N, said shift force detection unit including a current generator comprising a resistor in parallel with said switch, an amount of current of value N being produced when the battery voltage is across the resistor and the switch is open, an amount of current greater than N being produced when the switch closed, an amount of current greater than N being produced when the switch is abnormally short circuited, an amount of current less than N being produced when the shift detection unit has an open circuit or is disconnected, and an amount of current less than N being produced when the battery voltage falls below a predetermined value.

7. An outboard motor having a transmission unit, an electronic control unit, and a shift assist arrangement, said motor including an internal combustion engine having an engine block, a crankshaft, and a driveshaft communicating with the transmission unit, a shift assist control system including a force detecting unit comprising a shift force detecting switch and a parallel resistor circuit.

8. The outboard motor of claim 7, wherein the shift force detecting switch is connected to a portion of a shift mechanism, the force detecting unit being in communication through a communication means with the electronic control unit.

9. The outboard motor of claim 8, wherein the shift mechanism is connected to a dog clutch in the transmission unit.

10. The outboard motor of claim 8, wherein the electronic control unit lowers the engine torque dependent on the value of the current traveling through the force detecting unit.

11. The outboard motor of claim 8, wherein the shift mechanism includes a neutral detection switch.

12. The outboard motor of claim 8, wherein the force detecting unit and the electronic control unit communicate through an easily accessible connector.

13. The outboard motor of claim 10, wherein the electronic control unit lowers the engine torque by varying the fuel injection duration, the fuel injection timing, the ignition timing, and the air flow through an air bypass valve.

14. A method of assisting shifting of an engine having an electronic control unit which is not adversely affected by electrical short circuit or an electrical disconnect of a shift force detection unit comprising:

supplying a normal amount of current N to the electronic control unit, detecting when the amount of current exceeds or is less than the amount of current N by a predetermined amount of current, and automatically reducing the engine RPM when the amount of current exceeds or is less than the amount of current N by the predetermined amount of current.

15. The method of claim 14 wherein said amount of current N is produced by supplying the battery voltage across a resistor within the shift force detection unit.

16. The method of claim 15 wherein said amount of current is increased above N by the predetermined amount of current by closing a switch, which is electrically connected in parallel with said resistor, upon application of a force on a shift lever greater than a predetermined force value, so that said resistor is shorted when said switch is closed.

17. The method of claim 14 wherein a low battery voltage causes said amount of current to be lower than the amount of current N automatically resulting in the electronic control unit decreasing the engine RPM.

18. The method of claim 14, wherein detecting when the amount of current exceeds the amount of current N by a predetermined amount of current involves detecting when the amount of current is substantially equal to an amount of current indicative of a short circuited condition.

19. The method of claim 14, wherein detecting when the amount of current is less than the amount of current N by a predetermined amount of current involves detecting when the amount of current is substantially equal to an amount of current indicative of an open circuit condition.

* * * * *